US007326841B2

(12) United States Patent
Fadda

(10) Patent No.: US 7,326,841 B2
(45) Date of Patent: Feb. 5, 2008

(54) PERCUSSION INSTRUMENT

(76) Inventor: Giorgio Fadda, Viale Sabotino, 10, 20135, Milan (IT)

( * ) Notice: Subject to any disclaimer, the term of this patent is extended or adjusted under 35 U.S.C. 154(b) by 0 days.

(21) Appl. No.: 11/411,477

(22) Filed: Apr. 26, 2006

(65) Prior Publication Data

US 2007/0251373 A1 Nov. 1, 2007

(51) Int. Cl.
*G10D 13/02* (2006.01)

(52) U.S. Cl. ..... 84/411 R

(58) Field of Classification Search ..... 84/411 R, 84/421, 417

See application file for complete search history.

(56) References Cited

U.S. PATENT DOCUMENTS 3,029,679 A * 4/1962 La Londe ..... 84/411 R
2002/0178894 A1* 12/2002 Goods ..... 84/411 R

* cited by examiner

*Primary Examiner*—Kimberly Lockett
(74) *Attorney, Agent, or Firm*—Bucknam and Archer

(57) ABSTRACT

An improved percussion instrument, typically a drum (10) of whatever diameter and height, includes a cylindrical body (12) or barrel provided with a drum skin (14) secured to each of its opposite faces through respective rings (16-18) including a plurality of embossed appendixes (28) with an axial hole (30); the upper and lower edges of the mentioned body (12) are bent outwards so as to form respective ring-shaped bands (20-22) with one or more tongues (26) specially designed to cooperate with the mentioned appendixes (28) in stabilizing the rings (16-18).

8 Claims, 2 Drawing Sheets

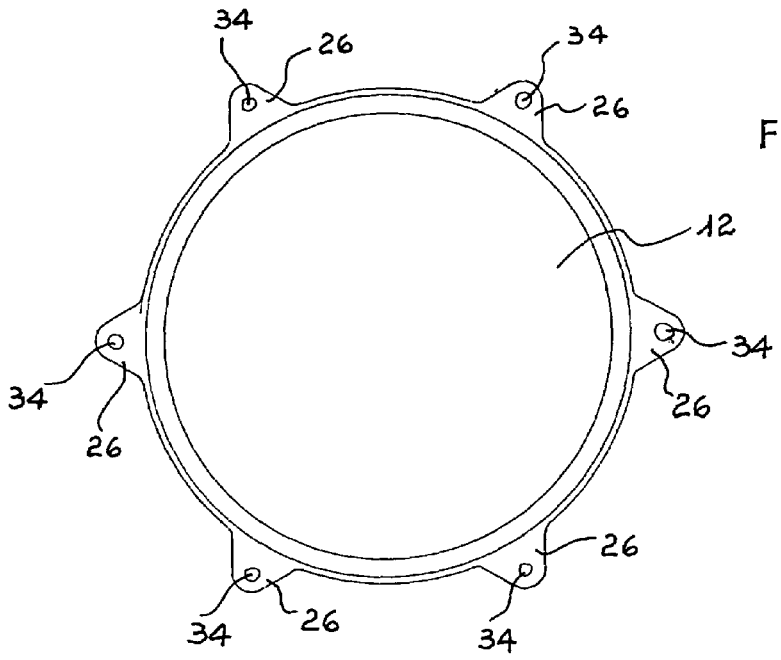
FIG. 3
FIG. 4
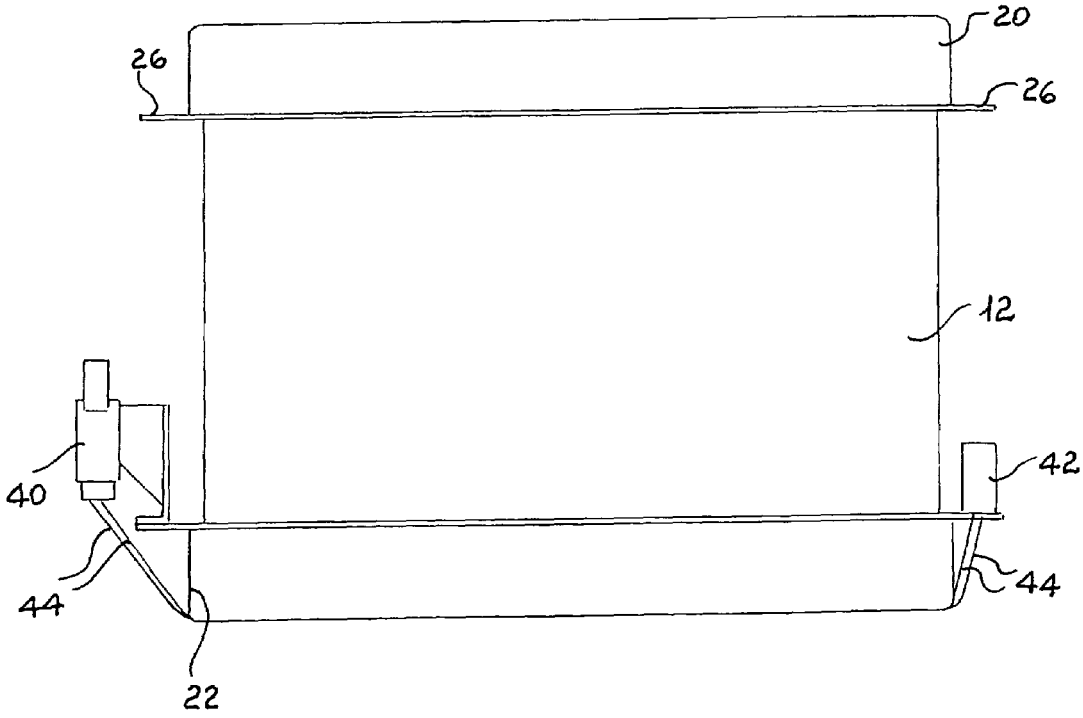

PERCUSSION INSTRUMENT

This invention refers to an improved percussion instrument. More specifically, this invention refers to an improved percussion instrument in the style of a drum, of whatever diameter and height, possibly such as the one that is generally used for the drums with other similar elements and possibly provided with a tailpiece.

It is known that, among of percussion instruments, traditionally common are the so-called drums, typically composed of a support or a barrel, which is made of a ring-shaped band that, on the opposite faces is closed by an equal number of stretched membranes or skins. The manual percussion of the latter, generally performed by means of drumsticks, produces the traditional sound with a rhythmical function, produced by the vibration caused by the instrument player. In some types of drums even a tailpiece can be found, that is to say a strip that is basically formed by braided metal wires, which can be tightened close to one of the mentioned skins, to produce a marked and strong sound, can be found.

In traditional drums, the skins that close up the ring-shaped band on the opposed faces are shaped along the perimeter to fit the respective edges of the mentioned band and are fastened to the band by means of rings that collaborate with threaded tie rods. More specifically, superimposed to the skins that are put on each of the opposed edges of the mentioned band is a metal ring, equipped with a plurality of equally spaced seats for the insertion of threaded tie rods. The latter members engage in an equal number of metal blocks, fastened to the outer side surface that forms the barrel of the drum; each block is equipped with opposed threaded holes, which develop parallelly to the vertical axis of the barrel, to receive both a screw that fastens the drumhead located on top and the screw that is aimed at stabilizing, with other ones, the drumhead that is fitted along the opposed lower edge. Alternatively, on the side band that forms the drum barrel two sets of blocks are fastened, where each set is suitable to fasten the tie rods of one of the drumhead skins. Along this very side band of traditional drum barrels, secured with further screws or equivalent means, the opposed tailpiece tensioning devices can also be found, which include the so-called tuning gear and the support that fastens the wires in a diametrically opposed position.

This traditional embodiment has proved to bring about significant problems.

Indeed, the presence of a large number of blocks with threaded seats along the outer side surface of the barrel actually distorts the purity of the sound generated by percussion, it being understood that the mentioned surface does not react to vibration in a regular way and also causes tuning problems.

A further serious problem found in some types of the known drums concerns the tensioning of the opposed drumhead skins, which cannot be properly measured in an independent manner, as in some cases both skins are secured to each block; therefore, the tensioning of one of them also affects, at least in part, the tensioning of the other one.

The object of this invention is to remedy the problems described above.

More specifically, the object of this invention is to provide an improved percussion instrument, namely a drum, which is such as to guarantee an absolute purity of the sound sent forth following the percussion of the skin(s).

A further object of this invention is to provide an instrument like the one described above, which can be easily tuned.

Not last among the object is to provide a drum which is such as to allow the opposed skins to be tensioned in an independent as well as measured way.

A further object of this invention is to provide a drum for which the traditional skins and the associated existing fastening rings can be used with no changes whatsoever.

A further object of this invention is to make available to the users a drum that is in a position to ensure a high level of strength and reliability over time, and also such as to be manufactured in an easy and cheap manner.

This and other objects are achieved by the improved percussion instrument of this invention, which includes a cylindrical body or barrel provided with a skin that is secured to each of its opposed faces by means of respective rings incorporating a plurality of embossed appendixes with an axial hole, and which is mainly characterized in that the upper and lower edges of the mentioned barrel are bent outwards to form respective ring-shaped bands equipped with one or more tongues that are specially designed to cooperate with the mentioned appendixes in stabilizing the rings.

The structural and functional characteristics of the improved percussion instrument of this invention can be better understood by the description that follows, where reference is made to the tables of attached drawings, which offer a preferred embodiment and are not meant to limit the invention to the precise form disclosed, wherein:

FIG. 3 is a schematic drawing of a layout view of the above improved percussion instrument;

FIG. 4 is a side view of the barrel of the above instrument.

Figure 1:
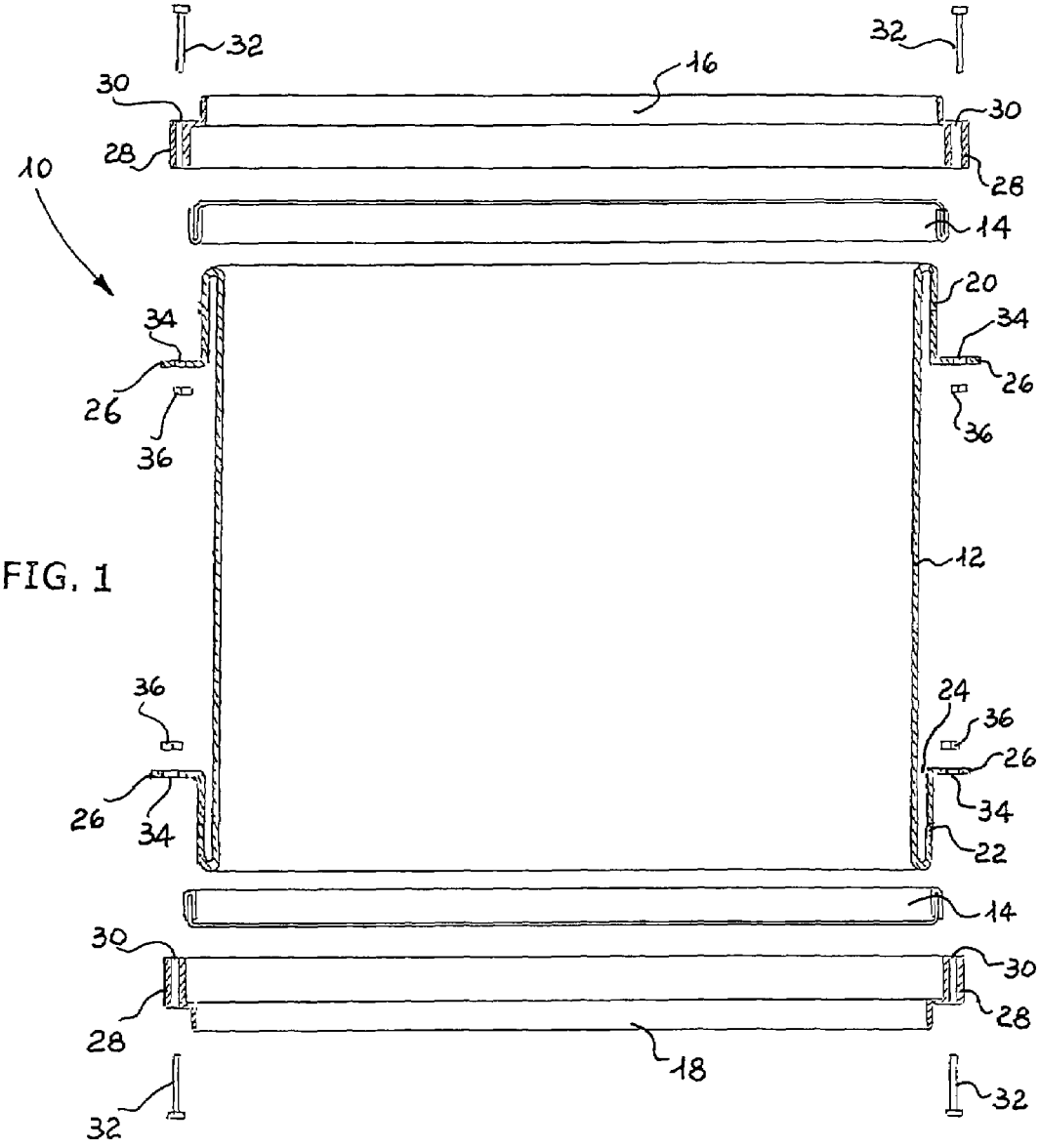
FIG. 1 is a schematic drawing, in a longitudinal section, the improved percussion instrument of this invention.

With reference to the mentioned figures, the improved percussion instrument of this invention, marked as a whole with 10 in FIG. 1, is a drum of whatever diameter and/or height composed of a cylindrical body 12 or barrel, at whose opposed faces a skin 14 delimited by a ring 16, 18, possibly a metal one, is secured. This barrel, advantageously, is also made from a metal such as bronze, copper, steel or titanium and, according to the invention, the opposed upper and lower edges of the body 12 are bent outwardly to form respective ring-shaped bands 20, 22, which develop adjacent and parallelly to the body; the height of such folds is illustratively comprised between 15 and 50 mm. As a function of the corresponding height of the body 12.

The width of the ring-shaped hollow 24 formed by these folds, that is the distance existing between the external surface of the body 12 or barrel and the inner surface of the folds ranges between 1 and 10 mm., preferably between 3 and 6 mm.

The ring-shaped bands 20 and 22 formed by the folds of the upper and lower edges or the body 12 or barrel are further bent to the outward side of the body 12, according to a direction that is advantageously orthogonal as to the side surface of the body itself, to form a continuous tensioned unit of limited width or, and preferably, a plurality of tongues 26, equally spaced from one another and of whatever shape, as schematized by way of an example in FIG. 3. The number of tongues 26 varies as a function of the size or diameter of the body 12 and corresponds to that of the corresponding embossed appendixes 28 of rings 16, 18, of a per se known type. These rings are traditionally located along the mentioned tongues 28 of a through-hole 30 vertically extended for the insertion of a screw or a threaded tie rod 32.

Even the tongues 26, formed by folds of the ring-shaped bands 20 and 22 are provided with a through-hole 34 and these holes are aligned to those 30 of rings 16 and 18.

Once the skins 14 have been fitted on the respective and opposed edges of the body 12, the rings 16 and 18 are superimposed to the skins, so as to allow the holes 30 of the mentioned rings to line up with the holes 34 of the tongues 26.

Figure 2:
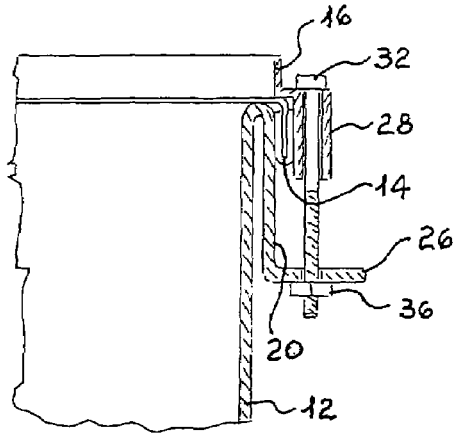
FIG. 2 is a schematic drawing, in a partial side view, of the above instrument, to highlight the means that secure one of the skins to the barrel.

Now, the screws 32 with a rod of suitable length are placed into the holes 30 and extend until part of their threaded rod sticks out of the holes 34 of the tongues 26, as detailed in FIG. 2.

Traditional nuts 36 or equivalent members allow the rings 16 and 18 to be secured on the skins 14 with the screws 32 and to tighten the latter on the body 12. This tensioning of either skin can advantageously be different from the other one, as a function of the instrumentalist's requirements, owing to the independent tensioning of the skins performed by the screws 32 that engage the rings 16 and 18 with the tongues 26 of the ring-shaped bands 20 and 22.

Even more advantageously is that such securing does not involve any preliminary arrangement of blocks that are integral with the outer surface of the body 12 or barrel, whereby all deterioration of the purity of the sound that is produced by the percussion can be avoided.

Even the traditional gear that stretches any tailpiece possibly provided (the latter is not shown) and the opposed wire anchoring device are appropriately spaced from the body or the barrel 12, as illustrated in FIG. 4.

The mentioned gear, referenced with 40, is actually fastened, with known means in the style of brackets or the like, to one of the tongues 26 of the ring-shaped band 22 of the body 12 and, in like manner, the opposed wire anchoring device 42, referenced with 44, is secured. The tongues 26 on which the gear 40 and the device 42 stand may obviously be different in shape and/or development from the tongues 26 described above, and may be located in any appropriate position along the ring-shaped band 22 or 20.

As noticeable from the above disclosure, the advantages achieved by the invention are manifest.

In the percussion instrument of this invention, the fastening of the skins 14 with the rings 16, 18 does not involve any positioning of engaging members to be integral with and sticking out of the body 12 or barrel, so as to avoid any possible deterioration of the purity of the sound; accordingly, the instrument can also be more easily tuned.

The possibility of fastening the skins 14 in an independent manner from one another to the body 12 also allows the skins to be tensioned in the most suitable manner as a function of the moment's requirements.

Last but not least is the further advantage coming from the possibility of matching the body or barrel 12 of suitable diameter with the traditional skins and the related lock rings, with no need of further changes to be entered.

Although the foregoing invention has been described by making reference to its preferential embodiment, which is provided for purposes of illustration and description and is not intended to be exhaustive, or to limit the invention to the precise form disclosed. Many variations and modifications of the embodiment described herein will be obvious to one of ordinary skills in the art in the light of the above disclosure. Therefore, the scope of the invention shall include all modifications and variations as defined by the claims appended thereto.

The invention claimed is:

1. In a percussion instrument, typically a drum (10) of whatever diameter and height, said instrument including a cylindrical body (12) having upper and lower edges defining opposed faces, a skin (14) fastened to each of said opposed faces of said cylindrical body (12), rings (16, 18) adapted to fasten each said skin (14) to each of said opposed faces, said rings (16, 18) having a plurality of embossed appendixes (28) each with an axial hole (30), the improvement comprising:

the upper and lower edges of said cylindrical body (12) being bent outwardly and developed adjacent and parallel to said cylindrical body to form respective ring-shaped bands (20, 22), and a plurality of tongues (26) associated with said ring-shaped bands (20,22) adapted to cooperate with said plurality of embossed appendixes (28) in stabilizing said rings (16, 18).

2. The percussion instrument as defined in claim 1, wherein said tongues (26) comprise one or more folds to the outside of said cylindrical body (12) of a free end of said ring-shaped bands (20,22) wherein said folds are formed with an orthogonal orientation as to a side surface of said cylindrical body (12).

3. The percussion instrument as defined in claim 1, wherein the number of said tongues (26) of said ring-shaped bands (20, 22) is at least equal to the number of embossed appendixes (28) of said rings (16, 18).

4. The percussion instrument as defined in claim 1, wherein said plurality of tongues (26) are formed with a through-hole (34) for insertion of a threaded rod of respective screws (32) coupled with nuts (36) and disposed in the holes (30) of said plurality of embossed appendixes (28) of said rings (16,18).

5. The percussion instrument as defined in claim 1, wherein tailpiece tensioning devices (40,42) are secured to two opposing tongues of said plurality of tongues (26) of said ring-shaped bands (20,22) by means of wires (44).

6. The percussion instrument as defined in claim 1, wherein the height of said ring-shaped bands (20, 22) is between 15 and 50 mm.

7. The percussion instrument as defined in claim 1, wherein the width of a ring-shaped hollow (24) formed between the ring-shaped bands (20,22) and said cylindrical body (12) is between 1 and 10 mm.

8. The percussion instrument as defined in claim 1, wherein the width of a ring-shaped hollow (24) formed between the ring-shaped bands (20, 22) and said cylindrical body (12) is between 3 and 6 mm.

* * * * *